US007054582B2

(12) United States Patent
Huang et al.

(10) Patent No.: US 7,054,582 B2
(45) Date of Patent: May 30, 2006

(54) TONER CARTRIDGE

(75) Inventors: Ya-Li Huang, Wuci Township, Taichung County (TW); Huang Ching-Yu, Taichung (TW); Wang Hui-Yen, Wuqi Town, Taichung County (TW)

(73) Assignee: General Plastic Industrial Co., LTD, Taichung (TW)

( * ) Notice: Subject to any disclaimer, the term of this patent is extended or adjusted under 35 U.S.C. 154(b) by 0 days.

(21) Appl. No.: 10/876,563

(22) Filed: Jun. 28, 2004

(65) Prior Publication Data

US 2005/0286936 A1 Dec. 29, 2005

(51) Int. Cl.
*G03G 15/08* (2006.01)

(52) U.S. Cl. ..... 399/262; 399/120; 399/258

(58) Field of Classification Search ..... 399/119, 399/262, 258, 120
See application file for complete search history.

(56) References Cited

U.S. PATENT DOCUMENTS

| | | | | |
|---|---|---|---|---|
| 5,613,177 | A * | 3/1997 | Meetze et al. | 399/263 |
| 5,887,227 | A * | 3/1999 | Kawai et al. | 399/119 X |
| 6,229,975 | B1 * | 5/2001 | Wilhelm et al. | 399/258 |
| 6,505,022 | B1 * | 1/2003 | Kosuge et al. | 399/120 X |
| 6,549,744 | B1 * | 4/2003 | Terazawa et al. | 399/262 |
| 6,597,883 | B1 * | 7/2003 | Muramatsu et al. | 399/258 |
| 2004/0197117 | A1 * | 10/2004 | Masuda et al. | 399/258 |

FOREIGN PATENT DOCUMENTS

| | | | |
|---|---|---|---|
| JP | 06-011966 | A * | 1/1994 |
| JP | 2003208003 | A * | 7/2003 |

* cited by examiner

*Primary Examiner*—Sophia S. Chen
(74) *Attorney, Agent, or Firm*—Browdy and Neimark, PLLC

(57) ABSTRACT

A toner cartridge has a housing for containing carbon powder therein. The housing has a tip end at which an outlet is provided. The housing further has a through hole in which a filter is mounted. An output device is mounted in the outlet of the housing. Accordingly, the toner cartridge smoothes the movement of the carbon powder out of the housing via the outlet to be recyclable and economical.

7 Claims, 5 Drawing Sheets

TONER CARTRIDGE

BACKGROUND OF THE INVENTION

1. Field of the Invention

The present invention relates generally to an electronic image output device, and more particularly to a toner cartridge.

2. Description of the Related Art

As shown in FIG. 1, a conventional toner cartridge 1 of an electronic image output device, such as a printer, is comprised of a housing 2 having a chamber 4 therein, and a soft bag 3 provided for containing carbon powder. The bag 3 has an outlet 5 and a cover 6 provided for sealing the outlet 5. The bag 3 is received in the chamber 4 of the housing 2 and the outlet 5 thereof is extruded out of the housing 2 to be connected to the electronic image output device. While the electronic image output device is working, the carbon powder runs out of the bag 3 via the outlet 5 and to the electronic image output device. The bag 3 will be replaced if the carbon powder runs out. The bag 3 of the toner cartridge 1 is made of a soft plastic material that is subject to vibration and is deformed when the carbon powder flows out of the bag 3 as creases form on the bag 3. In the meantime, the carbon powder is partially accumulated in the creases or in the outlet 5 to jam the outlet 5. To fix this problem, the user has to take the toner cartridge 1 out and shake it to eliminate the problem. In addition, when the carbon powder runs out, the bag 3 has to be replaced by a new one.

In addition, while replacing the bag 3 of the toner cartridge 1, the user who does not know the replacement steps well may spend much time for the replacement.

SUMMARY OF THE INVENTION

The primary objective of the present invention is to provide a toner cartridge, which can control the pressure in the cartridge to smooth the movement of carbon powder received therein.

The secondary objective of the present invention is to provide a toner cartridge, which is recyclable to be economical and ecologically protective.

The third objective of the present invention is to provide a toner cartridge, which is timesaving for refilling carbon power.

According to the objectives of the present invention, a toner cartridge is comprised of a housing and an output device. The housing has a chamber therein for containing carbon powder, an outlet formed at a bottom side thereof, a through hole, and a filter mounted in the through hole. The output device is mounted at the outlet of the housing. Accordingly, the present invention smoothes the movement of the carbon powder to be economical and ecologically protective.

DETAILED DESCRIPTION OF THE INVENTION

Figure 2:
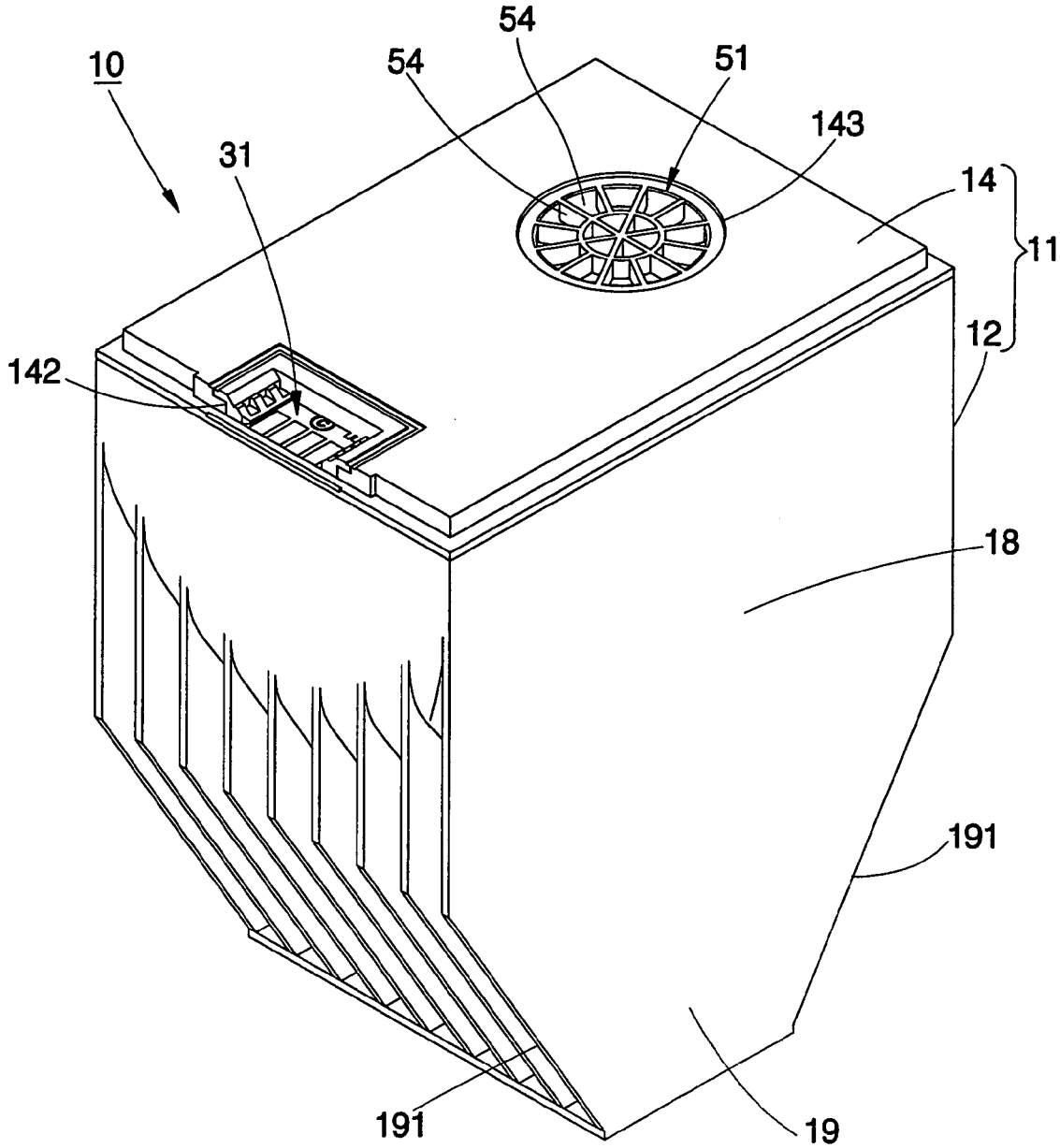
FIG. 2 is a perspective view of a first preferred embodiment of the present invention.
Figure 3:
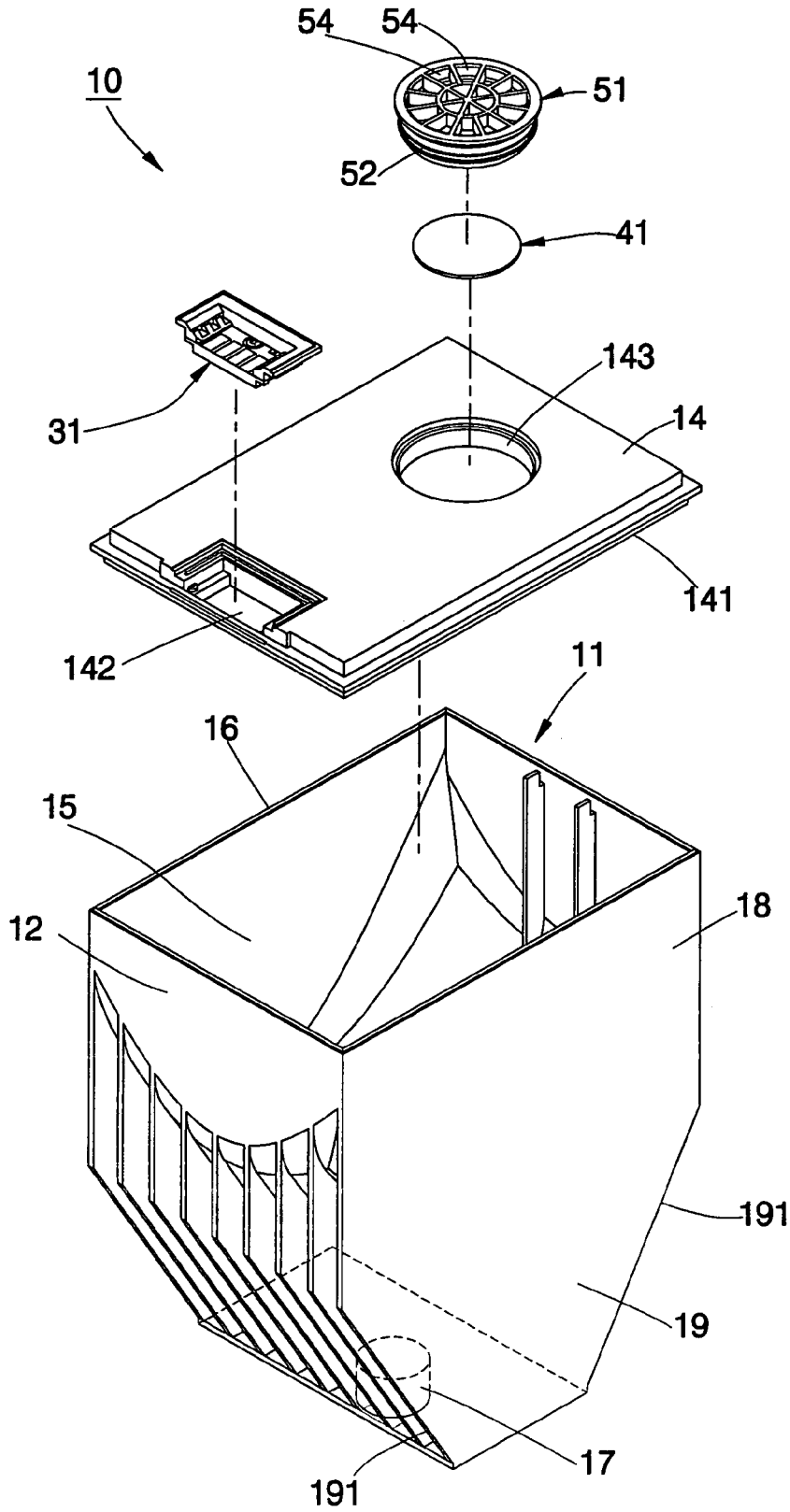
FIG. 3 is an exploded view of the first preferred embodiment of the present invention.
Figure 4:
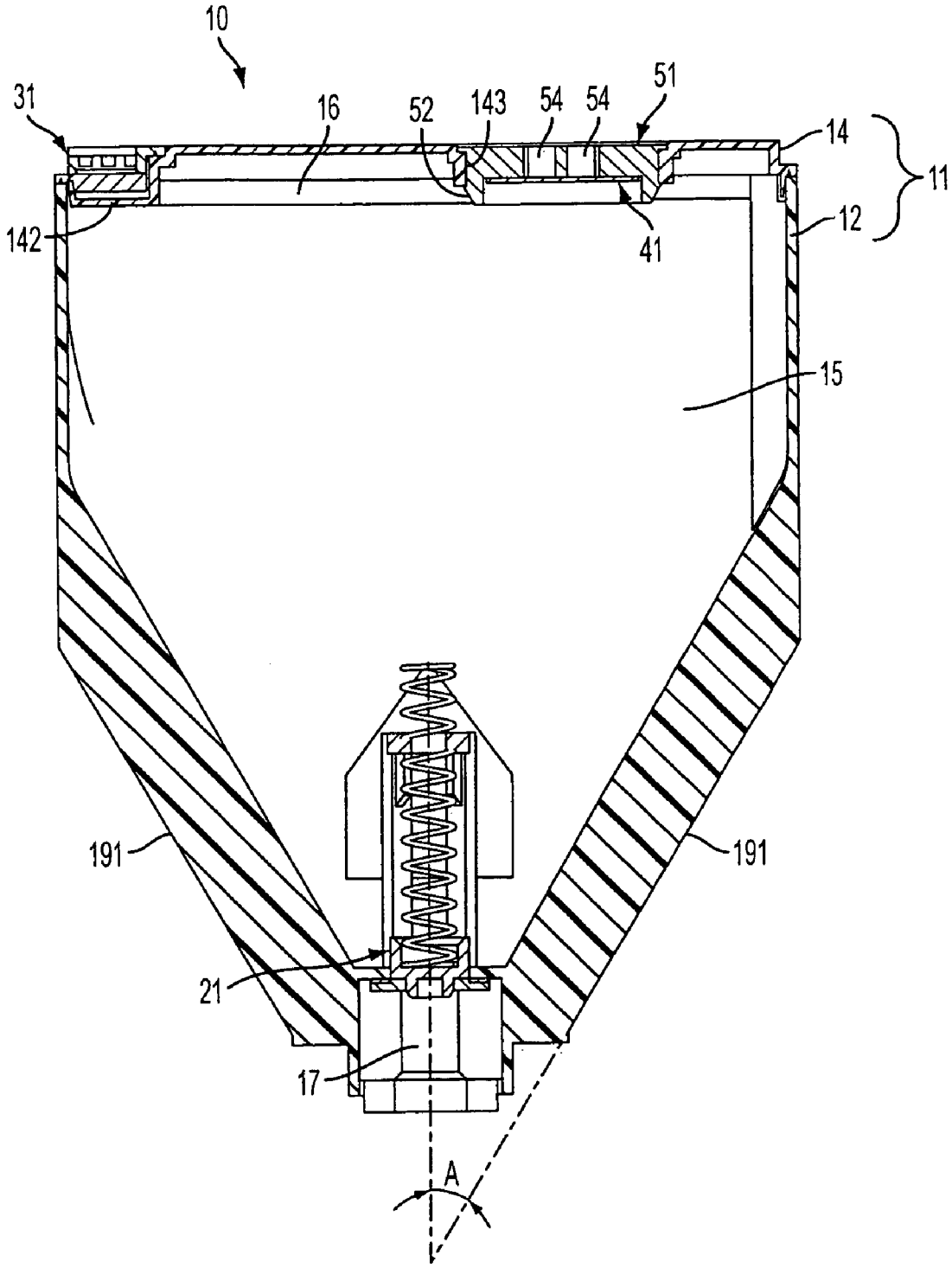
FIG. 4 is a sectional view of the first preferred embodiment of the present invention.

Referring to FIGS. 2–4, a toner cartridge 10 of a first preferred embodiment of the present invention comprises a housing 11 and an output device 21.

Figure 1:
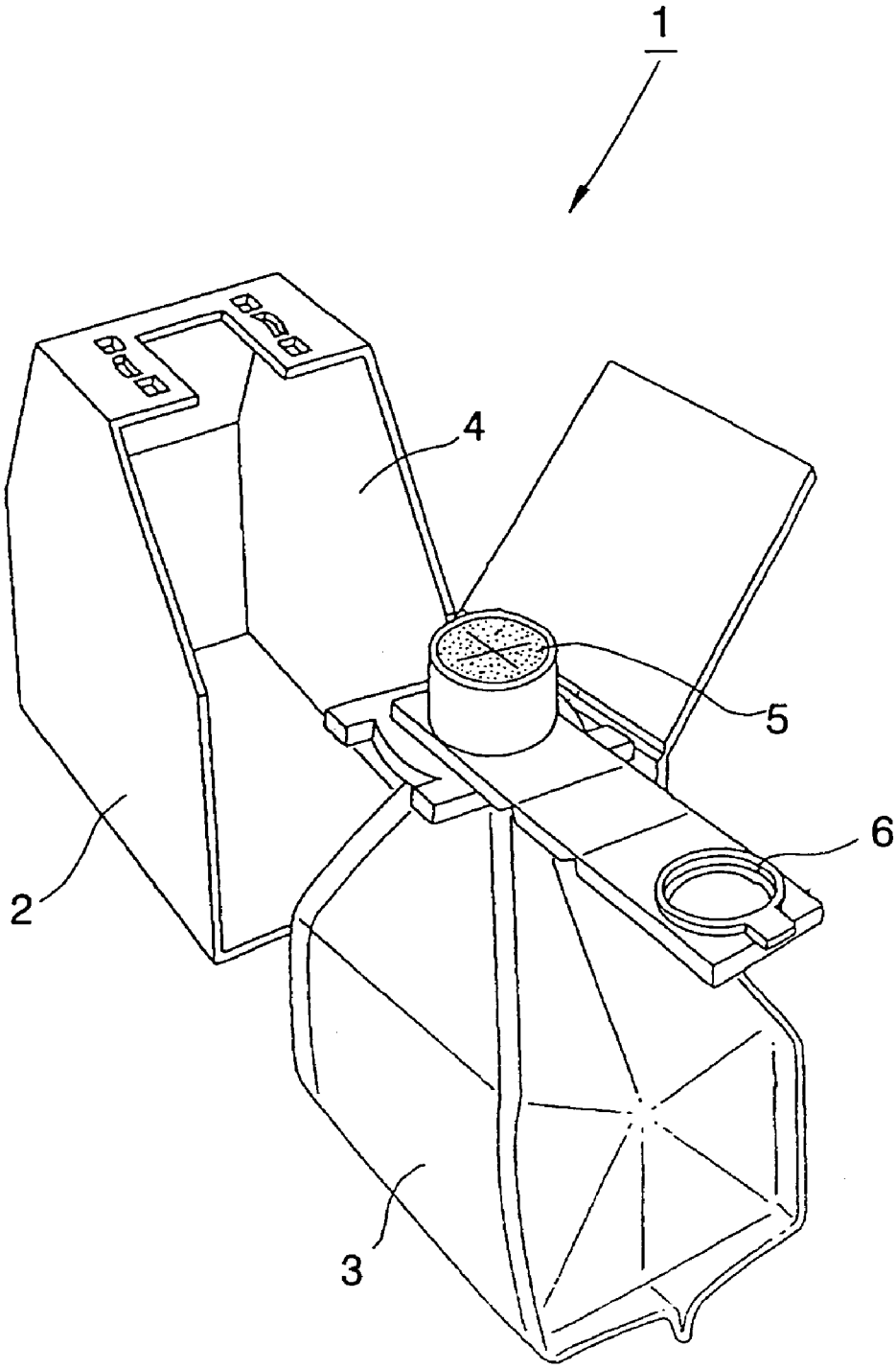
FIG. 1 PRIOR ART
FIG. 1 is a perspective view of a conventional toner cartridge.

The housing 11 is made of a hard plastic material, such as acrylonitrile-butadiene-styrene (ABS), polyethylene (PE), and polypropylene (PP) rather than a soft bag as in the prior art device of FIG. 1. The housing 11 has a main member 12 and a lid 14. The main member 12 has a chamber 15 formed inside for containing carbon powder therein, a rectangular opening 16 is formed at a top side thereof, and a round outlet 17 formed at a bottom side thereof. The lid 14 has a shape corresponding to the opening 16 of the main member 11 and a slot 141 formed at a periphery thereof. The lid 14 is stuck on the top side of the main member 11 and adhesively seals the opening 16. The lid 14 has a mount portion 142 for mounting a circuit board (31). The circuit board 31 can be connected with an image output device (not shown) for monitoring whether the toner cartridge 10 is installed in a correct condition. As shown in FIGS. 2–4, housing 11 has an upper portion 18, which is rectangular and has two pairs of side walls, and a lower portion 19, which extends downwards from the upper portion 18 and has two tilting side walls 191 having continuously and uniformly smooth inner walls, which tilt inwards to form the tip end at which the outlet 17 is located. An angle A between the tilting side wall 191 and an imaginary axis of the outlet 17 is in a range between 30 degrees and 80 degrees. The carbon powder can slide down along the inner sides of the tilting side walls 191 to smoothly run out of the housing 11 via the outlet 17 and not caught in creases as in the soft bag 3 of FIG. 1. The lid 14 is provided with a through hole 143 and a filter 41 mounted in the through hole 143. The filter 41 can be an air-permeable adhesive tape or other air-permeable material to allow the penetration of the air but the carbon powder to keep the carbon power from running out of the through hole 143, so that the air pressure inside the housing 143 can be effectively controlled to release the carbon powder out of the outlet 17.

The output device 21 is mounted in the outlet 17 of the housing 11 for connecting the housing 11 and the image output device (not shown) and for closing/opening the outlet 17. Because the output device 21 is a conventional device, no detailed recitation is necessary.

It is noted that the toner cartridge 10 of the present invention further has a plug device 51. The plug device 51 has a shape corresponding to the through hole 143 of the lid 14 and is provided with a lock portion 52 at a bottom thereof, which is engaged with the through hole 143 of the lid 14 at a periphery thereof to seal the through hole 143. The plug device 51 has a plurality of through portions 54 for enabling the air to flow through the through hole 143, and meanwhile, the carbon powder is still blocked by the filter 41. Accordingly, the toner cartridge of the present invention is capable of adjusting the air pressure in the chamber 15 of the housing 11. While the carbon powder in the housing 11 runs out, the user merely has to pull out the plug device 51 and refill the chamber 15 of the housing 11 with carbon powder via the through hole 143. After the refill of the carbon powder, the user merely has to put the plug device 51 back into the through hole 143 to finish the whole refill process. In the refill process, it is unnecessary for the user to detach the toner cartridge of the present invention from the image output device, thereby dramatically shortening the refill process.

Figure 5:
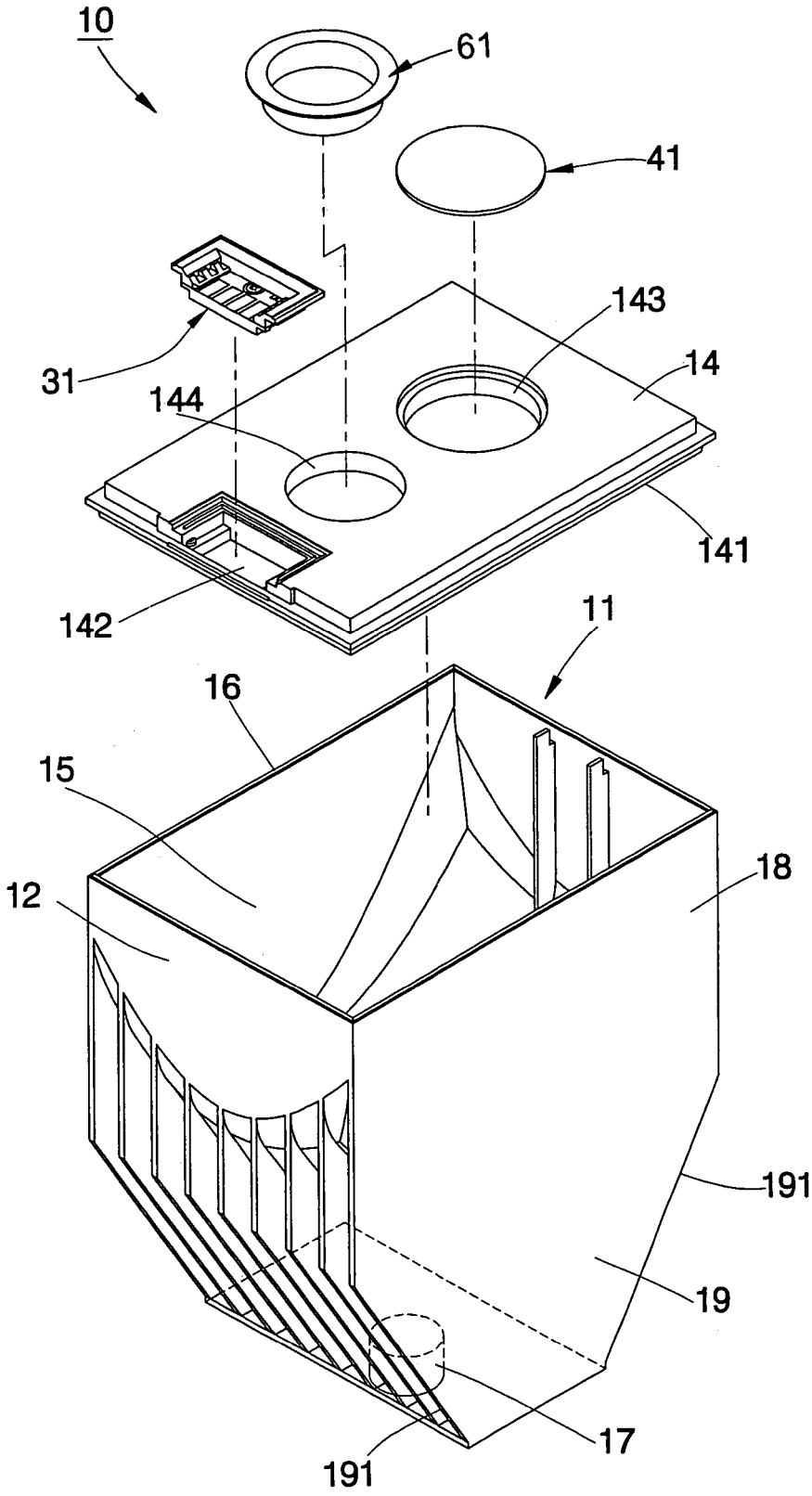
FIG. 5 is an exploded view of a second preferred embodiment of the present invention.

As shown in FIG. 5, the toner cartridge 10 of a second preferred embodiment of the present invention is similar to the toner cartridge 10 of the first preferred embodiment but different by that the lid 14 further includes a through hole 144 formed thereon, and the toner cartridge 10 further includes a plug device 61 having a shape corresponding to the through hole 144 to be mounted in the through hole 144 to seal and completely close the through hole 144, such that the through hole 144 is defined as an independent inlet for refilling the carbon powder.

In conclusion, the present invention provides the toner cartridge with the function of adjusting the air pressure in the housing to enable the carbon powder to be released out of the housing without interference. The present invention replaces the conventional soft bag with the rigid housing to contain the carbon powder that prevents the carbon powder from accumulation in toner cartridge. The tilting side walls of the housing smooth the release of the carbon powder. In addition, the toner cartridge of the present invention is recyclable to be economical. The refill process of the toner cartridge is short and less erroneous.

What is claimed is:

1. A toner cartridge for engagement and use with an image output device comprising:

a hard plastic housing having a main member and a lid for closing said main member;

said main member having side walls that are uniformly hard and smooth forming a chamber which directly abuts and holds carbon powder;

said lid having a through hole with a filter engaged therein;

a tip end of said main member having an outlet; and an output device mounted in said outlet;

wherein said chamber can be refilled through said through hole with the filter disengaged without disengaging the toner cartridge from the image output device.

2. The toner cartridge as defined in claim 1, wherein the side walls comprises two pair of upper side walls and two tilting lower side walls, at least one of said tilting side walls tilting inwards to form said tip end of the housing.

3. The toner cartridge as defined in claim 2, wherein one of said tilting lower side walls of the main member intersects with a longitudinal axis of the main member at an angle range of between 30 degrees and 80 degrees.

4. The toner cartridge according to claim 2, wherein the two pair of the upper side walls are planar and parallel to the longitudinal axis of the main member.

5. The toner cartridge as defined in claim 1 further comprising a plug device mounted in said through hole of said housing, wherein said plug device has at least one hollow portion and said filter is attached on said plug device to cover said hollow portion.

6. The toner cartridge as defined in claim 1 further comprising a plug device and a second through hole, wherein said plug device is mounted in said second through hole.

7. The toner cartridge according to claim 1, wherein said lid has a mounting portion for a circuit board for engagement to the image output device.

* * * * *